US005730222A

United States Patent [19]

Rike, Jr.

[11] Patent Number: 5,730,222

[45] Date of Patent: Mar. 24, 1998

[54] DOWNHOLE ACTIVATED CIRCULATING SUB

[75] Inventor: Emanuel Andrew Rike, Jr., Anchorage, Ak.

[73] Assignee: Dowell, a Division of Schlumberger Technology Corporation, Houston, Tex.

[21] Appl. No.: 575,437

[22] Filed: Dec. 20, 1995

[51] Int. Cl.[6] ..... E21B 21/10; E21B 34/12

[52] U.S. Cl. ..... 166/373; 166/323; 166/334.4; 175/317; 175/324

[58] Field of Search ..... 166/373, 334.1, 166/334.4, 323; 175/107, 317, 324

[56] References Cited

U.S. PATENT DOCUMENTS

| | | | |
|---|---|---|---|
| 3,823,788 | 7/1974 | Garrison et al. | 175/107 X |
| 3,853,177 | 12/1974 | Mott | 175/317 X |
| 4,044,829 | 8/1977 | Jessup et al. | 166/323 X |
| 4,436,166 | 3/1984 | Hayatdavoundi et al. | 175/324 X |
| 4,858,690 | 8/1989 | Rebardi et al. | 166/334.4 X |
| 4,926,949 | 5/1990 | Forrest | 175/107 X |
| 5,368,109 | 11/1994 | Pittard, Jr. et al. | 175/107 X |
| 5,472,057 | 12/1995 | Winfree | 175/107 X |

*Primary Examiner*—George A. Suchfield
*Attorney, Agent, or Firm*—John E. Vick, Jr.

[57] ABSTRACT

A downhole activated circulating sub is adapted to be interconnected between various tools installed on coiled tubing and placed into a wellbore; for example, between a coiled tubing/measurement while drilling tool and a downhole motor/drill bit for drilling a wellbore. The circulating sub can be repeatedly set and reset while the circulating sub is disposed in the wellbore. As a result, it is not necessary to retrieve the circulating sub to the wellbore surface for the purpose of resetting the sub. The circulating sub includes a latch mechanism which locks and latches the sub in either a set condition or a reset condition when a fluid is pumped through the circulating sub. When fluid flow through the circulating sub stops, the latch mechanism is unlocked and the circulating sub can change between the set condition and the reset condition. When fluid flow stops and the latch mechanism is unlocked, in response to a pull or a push on the coiled tubing, the coiled tubing will move laterally a distance of about 1½ inches which will enable a mandrel to move. When the mandrel moves, a second pair of upsets on a mandrel in the circulating sub moves from a first position surrounding a first upset on an intermediate member to a second position surrounding a second upset on the intermediate member. This movement of the mandrel changes the condition of the circulating sub between the set condition and the reset condition. When fluid flow through the circulating sub restarts, the latch mechanism once again latches the circulating sub in either the set or reset condition.

12 Claims, 6 Drawing Sheets

DOWNHOLE ACTIVATED CIRCULATING SUB

BACKGROUND OF THE INVENTION

The subject matter of the present invention relates to a circulating sub for use downhole with Bottom Hole Assemblies (BHA) that are commonly used with drilling and workover operations, the circulating sub having the capability to be repeatedly operated and reset downhole in the wellbore and therefore it is not necessary to retrieve the sub to the surface of the wellbore for the purpose of resetting the circulating sub after it has been activated and cycled downhole. No wireline or control line is used or needed.

A conventional drop ball type circulating sub currently in use is operated by dropping a ball into the circulating path. When the drop ball type circulating sub is activated downhole, it cannot be reset downhole, rather, it is necessary to reset the sub at a surface of the wellbore after it is activated downhole. In order to activate the drop ball type circulating sub, a ball is dropped downhole, the ball landing on a seat of the circulating sub and shearing a device in the sub. At this point, fluid, circulating through the sub, is diverted around the downhole tools installed below it, effectively bypassing the tools. Therefore, any flow activated tools installed below are inoperative. For example, a drill bit, connected to a motor, no longer rotates. It will be necessary to reset the circulating sub to its former state, which will again allow the fluid to circulate through the circulating sub and through the tools below for the purpose of operating the tools or performing some operation in the wellbore.

The conventional sub cannot be reset to its former position while situated in the wellbore. In order to reset the conventional circulating sub to its former state, it is necessary to perform an extra step, namely, retrieving the circulating sub to a surface of the wellbore, resetting the sub at the surface, and tripping the circulating sub back into the wellbore for the purpose of performing subsequent wellbore operations. This extra step requires additional time and money, both of which could be saved if a new circulating sub were designed which could be repeatedly set and reset in the wellbore without also requiring the aforementioned extra step of retrieval of the sub to the surface, resetting at the surface, and tripping back into the wellbore.

SUMMARY OF THE INVENTION

Accordingly, it is a primary object of the present invention to provide a new downhole activated circulating sub which can be repeatedly set and reset while the circulating sub is disposed in a wellbore without retrieving the circulating sub to the surface of the wellbore for the purpose of resetting the circulating sub.

It is a further object of the present invention to provide a new downhole activated circulating sub adapted to be interconnected between a measurement while drilling (MWD) tool and a downhole motor and drill bit for drilling a wellbore, the circulating sub being repeatedly set and reset downhole when the circulating sub is disposed in the wellbore without requiring the additional steps of retrieving the sub to the surface of the wellbore for the purpose of resetting the sub and subsequently tripping the sub back into the wellbore.

It is a further object of the present invention to provide a downhole activated circulating sub adapted to be interconnected between an MWD tool and a downhole motor/drill bit for drilling a wellbore, the circulating sub including a latch mechanism for locking and latching the circulating sub in either a set condtion or a reset condition when fluid is being pumped through the circulating sub and unlocking and unlatching the circulating sub from either the set condition or the reset condition when fluid is not being pumped through the circulating sub, the circulating sub changing from the set condition to the reset condition while the circulating sub is disposed in the wellbore when the fluid is not being pumped through the circulating sub and the latch mechanism unlocks and unlatches the circulating sub from the set condition, the circulating sub changing from the reset condition to the set condition while the circulating sub is disposed in the wellbore when the fluid is not being pumped through the circulating sub and the latch mechanism unlocks and unlatches the circulating sub from the reset condition.

In accordance with these and other objects of the present invention, a downhole activated circulating sub is adapted to be interconnected between a coiled tubing/measurement while drilling (MWD) tool and a downhole motor/drill bit for drilling a wellbore. The circulating sub can be repeatedly set and reset while the circulating sub is disposed in the wellbore. As a result, it is not necessary to retrieve the circulating sub to the wellbore surface for the purpose of resetting the sub. The circulating sub includes a latch mechanism which locks and latches the sub in either a set condition or a reset condition when a fluid is pumped through the circulating sub. When fluid flow through the circulating sub stops, the latch mechanism is unlocked and the circulating sub can change between the set condition and the reset condition. When fluid flow stops and the latch mechanism is unlocked, in response to a pull or a push on the coiled tubing, the coiled tubing will move laterally a distance of about 1½ inches which will enable a mandrel in the circulating sub to move. When the mandrel moves, a pair of upsets on a mandrel in the circulating sub moves from a first position surrounding a first upset on an intermediate member to a second position surrounding a second upset on the intermediate member. This movement of the mandrel changes the condition of the circulating sub between the set condition and the reset condition. When fluid flow through the circulating sub restarts, the latch mechanism once again latches and locks the circulating sub in either the set or reset condition.

For example, when the circulating sub is disposed in the set, activated condition, a fluid can circulate through the MWD tool, through the circulating sub, and through the downhole motor for rotating the drilling bit. However, when the sub is disposed in the reset, deactivated condition, the fluid can circulate through the MWD tool and through the circulating sub, but, at this point, the fluid is diverted from the circulating sub transversely into the wellbore effectively bypassing the downhole motor, stopping the rotation of the drilling bit, and allowing the MWD tool to be operated without also operating the downhole motor. The circulating sub of the present invention includes a central mandrel, and a pair of ports disposed through a wall thereof for flowing a fluid from the full bore of the central mandrel through the pair of ports. The circulating sub includes an outer housing having another pair of ports which are adapted to meet into congruence with the pair of ports in the central mandrel when the central mandrel is disposed in a first lateral position and to move out of congruence with the pair of ports in the central mandrel when the central mandrel is disposed in a second lateral position within the circulating sub. The outer housing of the circulating sub also includes a full bore disposed at one of its ends, the pair of ports in the central mandrel fluidly communicating with the full bore of the outer housing when the central mandrel is disposed in the second lateral position within the circulating sub and the pair of ports in the outer housing move out of congruence with the pair of ports in the central mandrel. The circulating sub further includes a latch mechanism which latches and locks the central mandrel in either the fast lateral position (the reset condition) or the second lateral position (the set condition) within the circulating sub when a fluid is flowing through the full bore of the central mandrel. When the fluid is not flowing through the full bore of the central mandrel, the latch mechanism is unlatched and unlocked, and, as a result, the central mandrel can change between the first lateral position (the reset condition) and the second lateral position (the set condition) within the circulating sub. On the other hand, when fluid flows within the full bore of the central mandrel, the central mandrel cannot change between the first lateral position (the reset condition) and the second lateral position (the set condition). The latch mechanism includes an intermediate member having a first upset and a second upset, and the central mandrel includes a pair of upsets adapted to wrap around either the first upset or the second upset on the intermediate member. When the central mandrel is disposed in the first lateral position, the second pair of upsets on the central mandrel wraps around the first upset on the intermediate member. However, when fluid no longer flows within the central mandrel of the circulating sub, the central mandrel can move upwardly or downwardly, and a pull or push on the coiled tubing connected to any tools below the sub will change the location of the central mandrel from the first lateral position to the second lateral position. When the central mandrel is disposed in the second lateral position, the second pair of upsets on the central mandrel wrap around the second upset on the intermediate member. Consequently, when the fluid no longer flows within the central mandrel, the central mandrel can change between the first and second lateral positions within the circulating sub, and this allows the circulating sub to repeatedly change between a set, activated condition and a reset, deactivated condition while the circulating sub is disposed within the wellbore. As a result, it is no longer necessary to retrieve the circulating sub to the surface of the wellbore in order to reset and deactivate the circulating sub.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
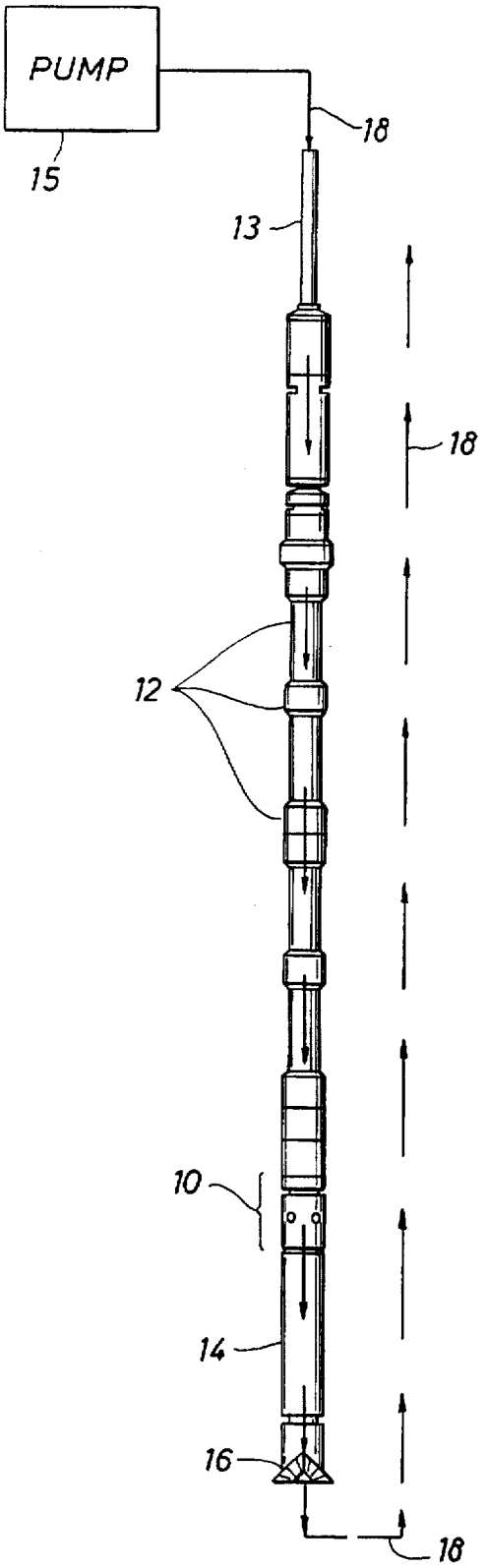
FIG. 1 illustrates the downhole activated circulating sub of the present invention interconnected between a measurement while drilling tool and a downhole motor and drill bit in a wellbore when the sub is disposed in the set, activated condition.

Referring to FIG. 1, a downhole activated circulating sub 10 in accordance with the present invention is adapted to be disposed in a wellbore. The circulating sub 10 is adapted to be interconnected between various types of tools installed on coiled tubing and placed into a wellbore. For example, in the preferred embodiment, which is given by way of example only and is not limitative of the present invention, the circulating sub 10 is adapted to be interconnected between a measurement while drilling (MWD) tool 12, on one side, and a downhole motor 14 and a drill bit 16, on the other side. A coiled tubing 13 is shown connected between a pump 15 and the MWD tool 12 in FIGS. 1 and 2. The pump 15 pumps a fluid 18 into the coiled tubing 13. In FIG. 1, the circulating sub 10 is disposed in the set, activated condition. Since the circulating sub 10 of FIG. 1 is disposed in the set, activated condition, the fluid 18, which is pumped into the coiled tubing 13 and the circulating sub 10 from the pump 15, flows through the coiled tubing 13, through the MWD tool 12, through the circulating sub 10, through the downhole motor 14, and through the drill bit 16, rotating the drill bit 16 for the purpose of drilling a wellbore in an earth formation.

Figure 2:
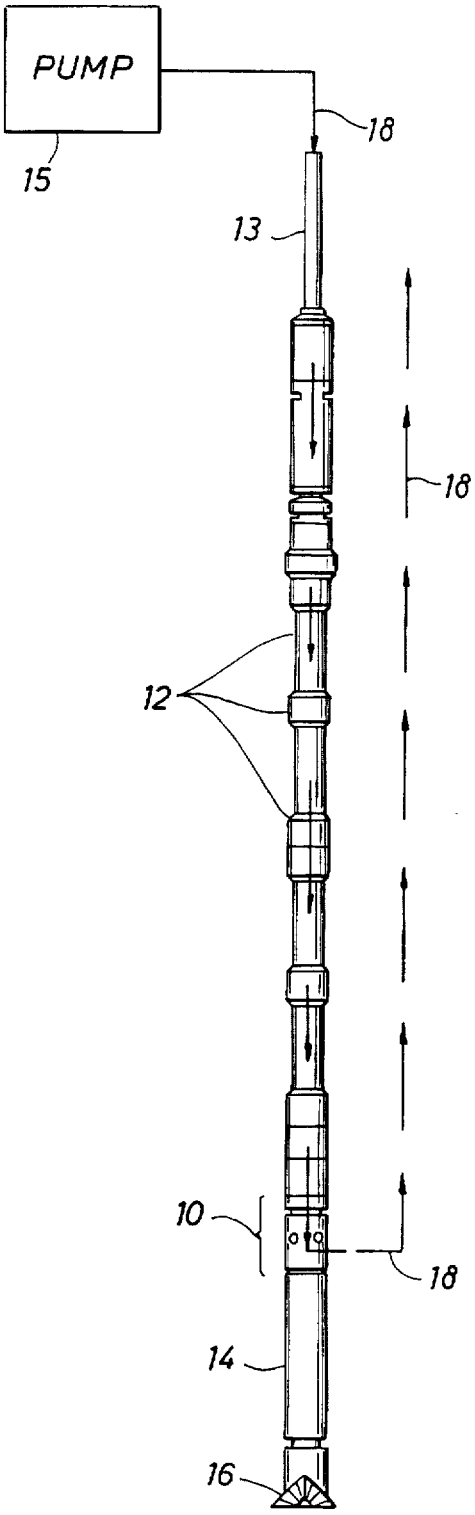
FIG. 2 illustrates the downhole activated circulating sub of the present invention interconnected between a measurement while drilling tool and a downhole motor and drill bit in a wellbore when the sub is disposed in the reset, deactivated condition.

However, referring to FIG. 2, the circulating sub 10 has changed from the set, activated condition (of FIG. 1) to a reset, deactivated condition as shown in FIG. 2. As a result, since the circulating sub 10 is disposed in the reset, deactivated condition, the fluid 18 must now flow through the coiled tubing 13, through the MWD tool 12, through the circulating sub 10, and away from the downhole motor 14, initially in a direction which is approximately perpendicular to the circulating sub 10, and subsequently uphole. As a result, in FIG. 2, the fluid 18 has been diverted away from the downhole motor 14. Consequently, the downhole motor 14 stops operating and the drill bit 16 stops rotating. When the circulating sub 10 is disposed in the reset, deactivated condition of FIG. 2, the MWD tool 12 can be operated without also operating the downhole motor 14 or the drill bit 16.

Referring to FIGS. 3*a* to 4*e*, the downhole activated circulating sub 10 of FIGS. 1 and 2, in accordance with the present invention, is illustrated. FIGS. 3*a*–3*e* illustrate the downhole activated circulating sub 10 of the present invention disposed in the set, activated condition of FIG. 1, and FIGS. 4*a*–4*e* illustrate the downhole activated circulating sub 10 disposed in the reset, deactivated condition of FIG. 2.

Figure 3A:
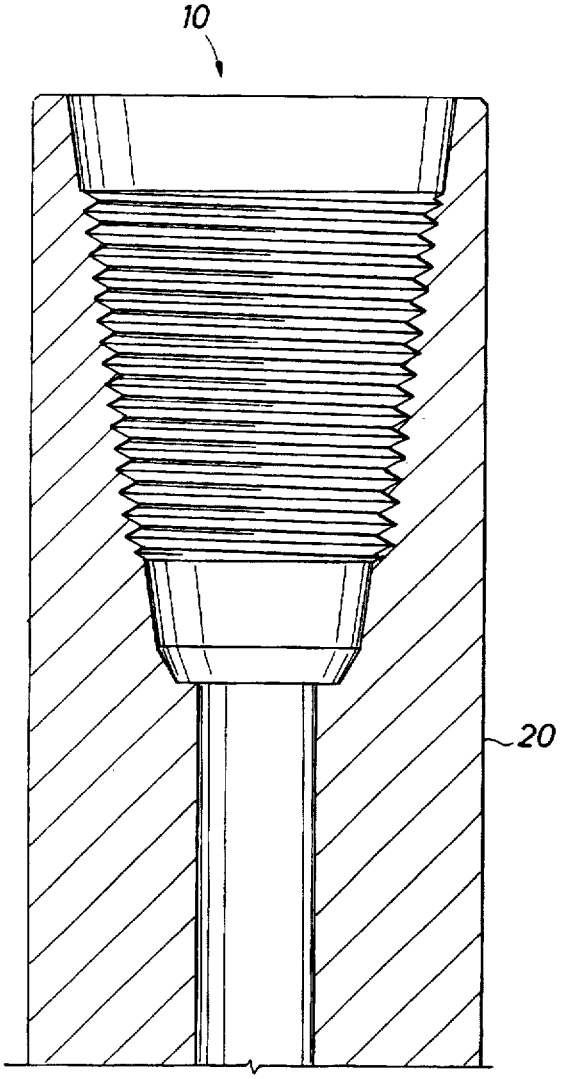
FIGS. 3*a*–3*e* illustrate the downhole activated circulating sub of the present invention disposed in the set, activated condition of FIG. 1.
Figure 4A:
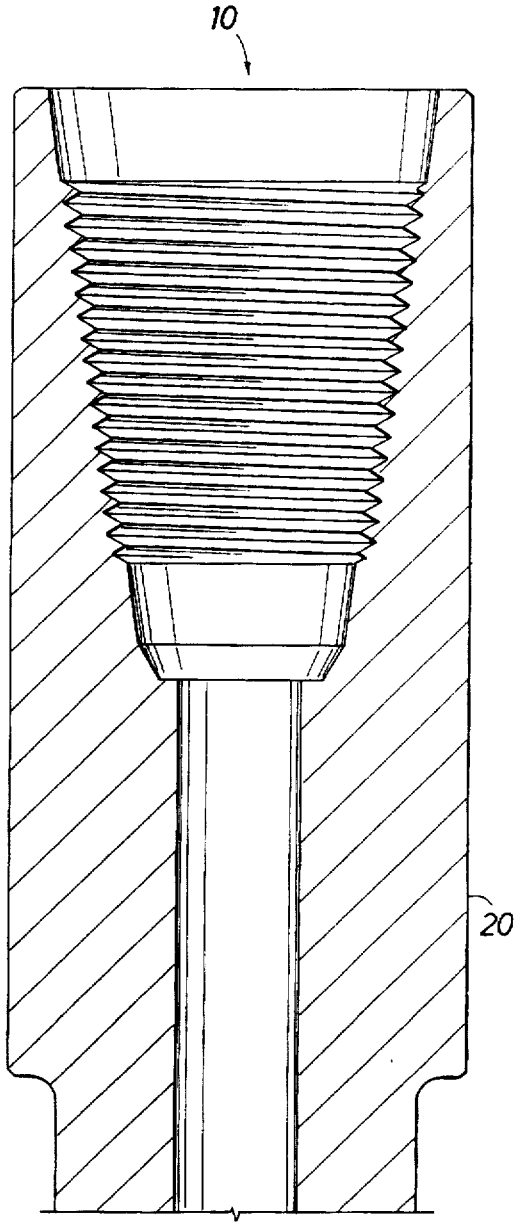
FIGS. 4*a*–4*e* illustrate the downhole activated circulating sub of the present invention disposed in the reset, deactivated condition of FIG. 2.
Figure 3B:
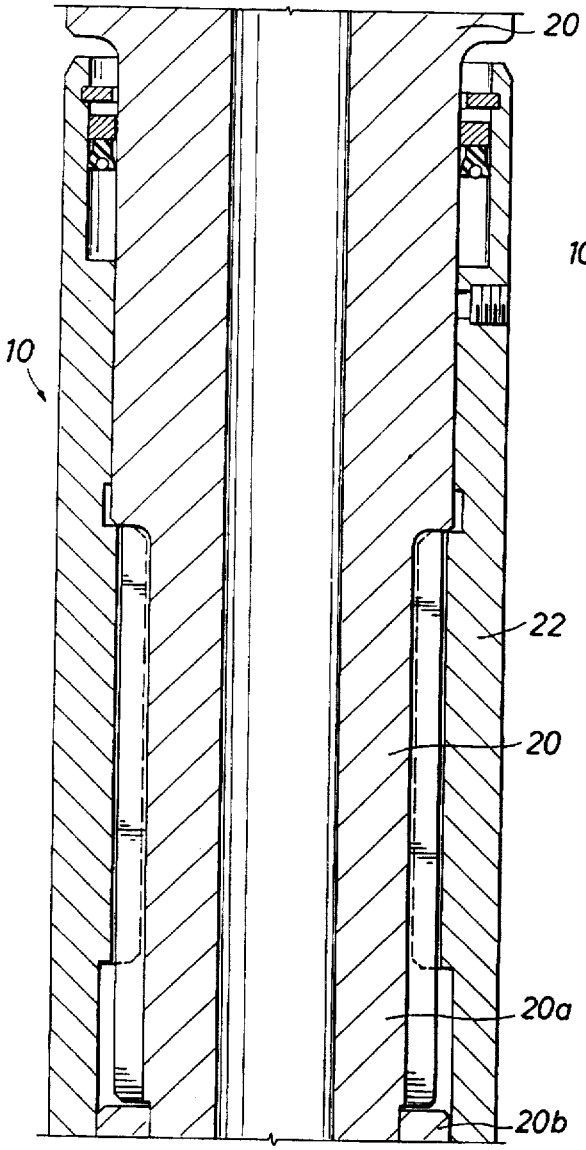
Figure 4B:
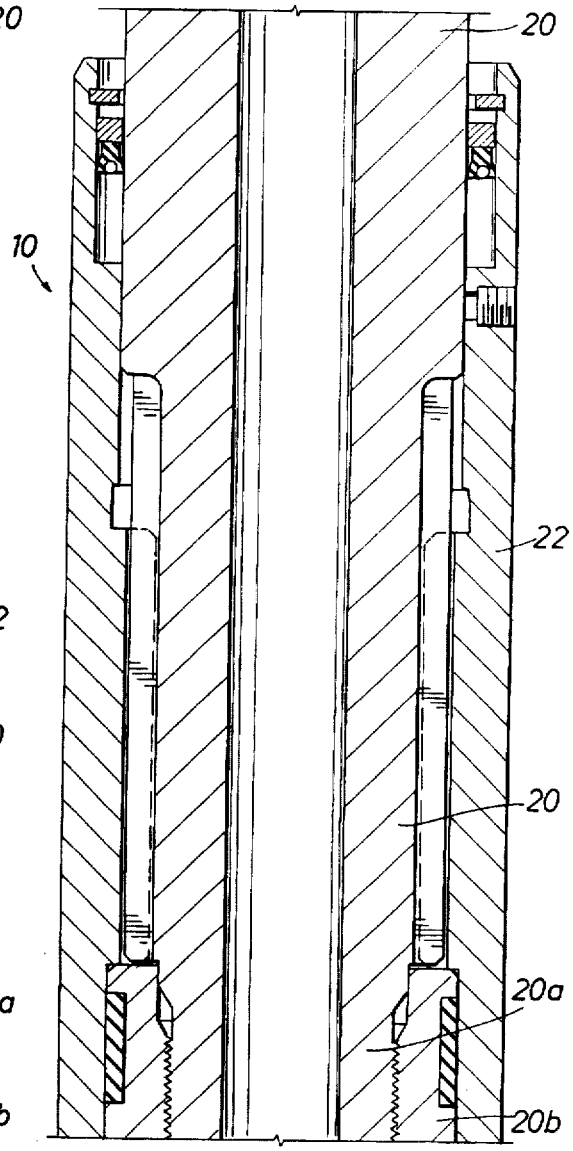
Figure 3C:
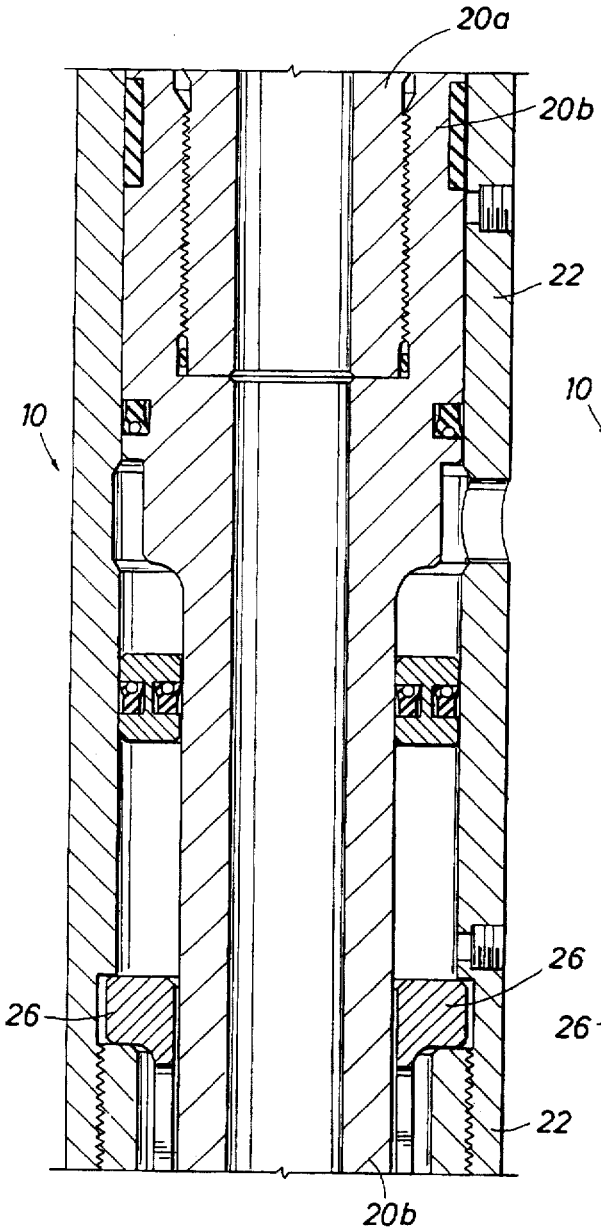
Figure 4C:
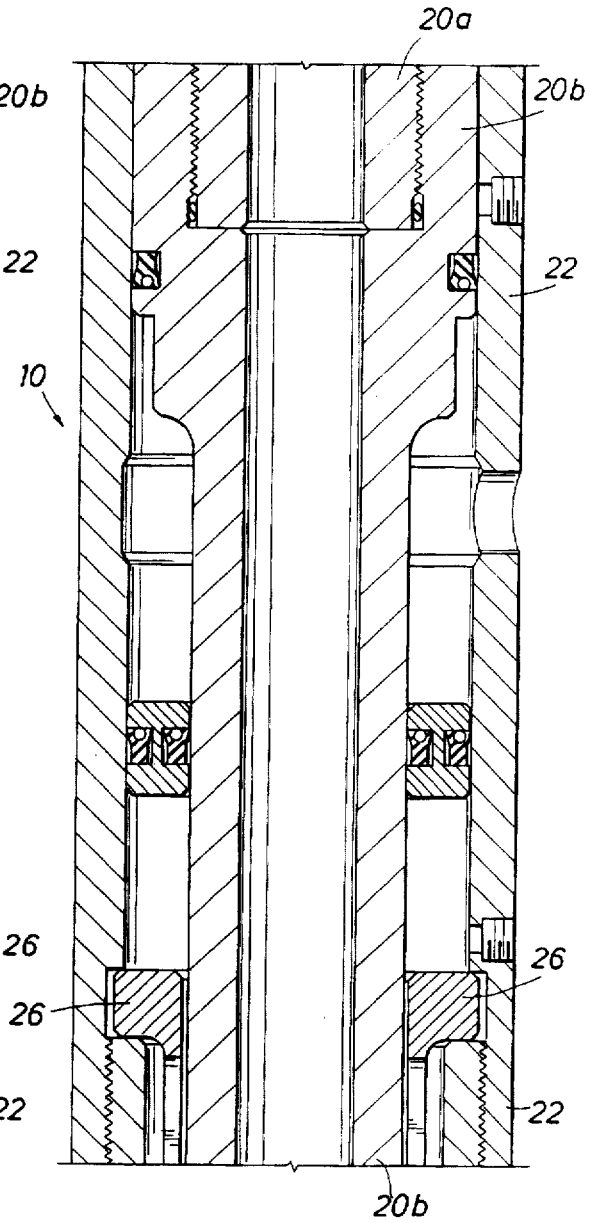
Figure 3D:
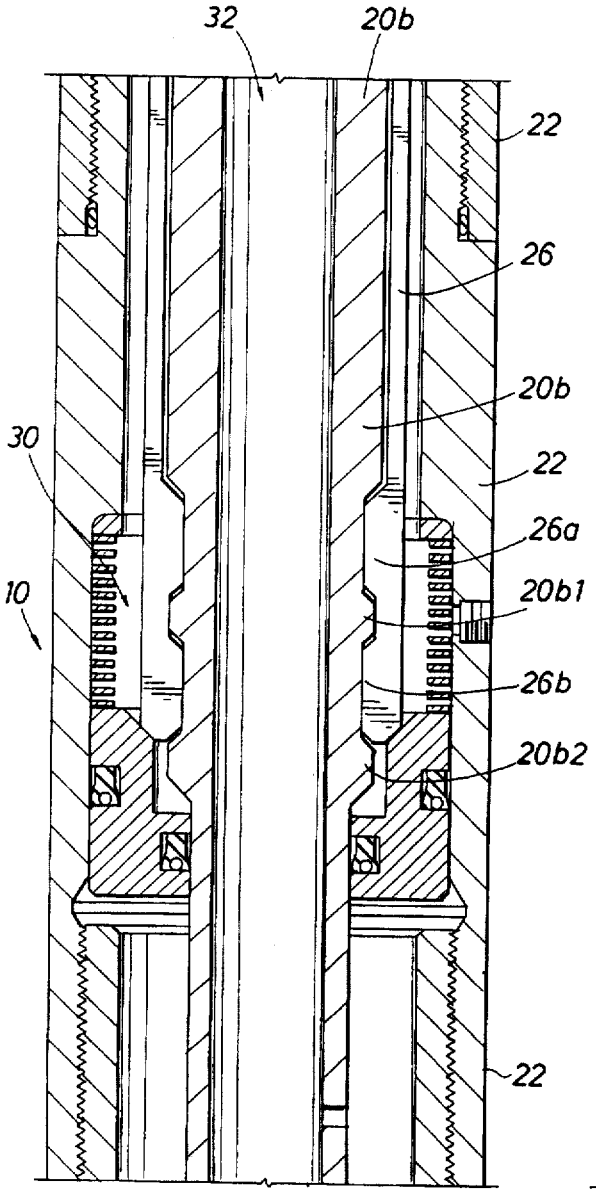
Figure 4D:
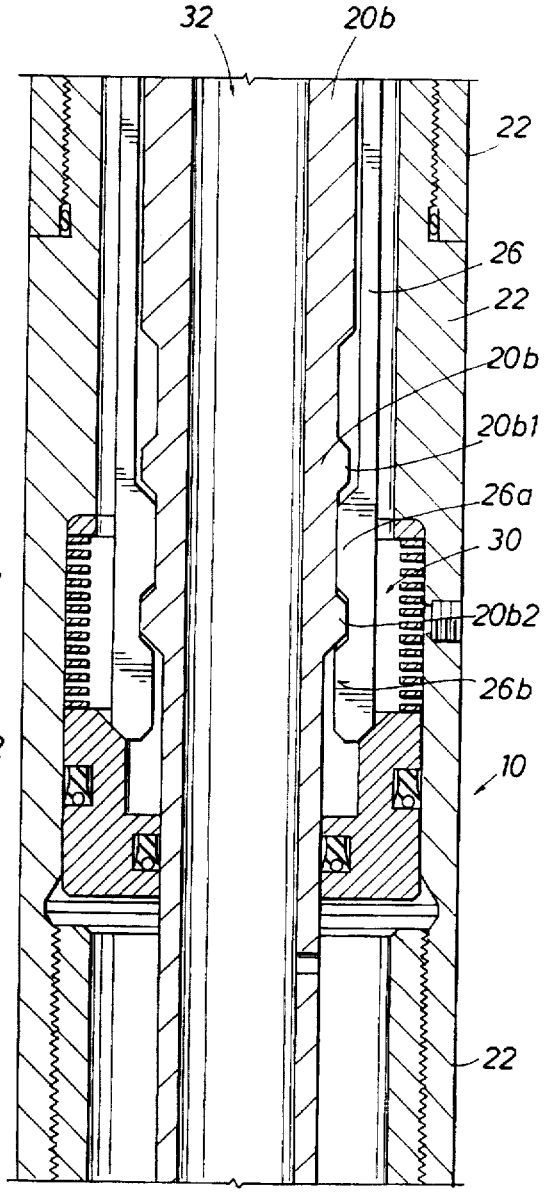

In FIGS. 3*a* and 4*a*, the circulating sub 10 includes a central mandrel 20. In FIGS. 3*b* and 4*b*, the central mandrel 20 is again shown to be movable laterally or longitudinally within an outer housing 22. In the drawings, the central mandrel 20 is actually comprised of a plurality of individual mandrels. For example, in FIGS. 3*b* and 4*b*, the central mandrel 20 includes a first mandrel 20*a* and a second mandrel 20*b* connected to and movable with the first mandrel 20*a*. In FIGS. 3*c* and 4*c*, the first mandrel 20*a* terminates and the second mandrel 20*b* extends longitudinally down the length of FIGS. 3c and 4c, the second mandrel 20b being enclosed by the outer housing 22. In the lower part of FIG. 3c and FIG. 4c, an intermediate member 26 is shown disposed between the second mandrel 20b and the outer housing 22. In FIGS. 3d and 4d, the same intermediate member 26 is again shown to be disposed between the second mandrel 20b and the outer housing 22.

However, in addition, in FIGS. 3d and 4d, the downhole activated circulating sub 10 includes a latch mechanism 30. In FIGS. 3d and 4d, the latch mechanism 30 includes: (1) the intermediate member 26, the intermediate member 26 further including a first pair of upsets 26a and 26b, the first pair of upsets 26a and 26b further including a first upset 26a and a second upset 26b, and (2) the second mandrel 20b which further includes a second pair of upsets 20b 1 and 20b2. Note that, in FIG. 4d, the second pair of upsets 20b 1 and 20b2 on the second mandrel 20b are wrapped around the first upset 26a of the fast pair of upsets on the intermediate member 26; however, in FIG. 3d, the second pair of upsets 20b1 and 20b2 are wrapped around the second upset 26b of the first pair of upsets on the intermediate member 26. The second pair of upsets 20b1 and 20b2 are wrapped around the first upset 26a in FIG. 4d because the circulating sub 10 in FIG. 4d is disposed in the reset, deactivated condition; whereas, the second pair of upsets 20b 1 and 20b2 are wrapped around the second upset 26b in FIG. 3d because the circulating sub 10 in FIG. 3d is disposed in the set, activated condition. Recall that fluid 18 will be flowing within the full bore 32 in FIGS. 3d and 4d. When the fluid 18 flows within the full bore 32, because of the pressure of the fluid 18 in the full bore 32, the second pair of upsets 20b 1 and 20b2 in FIG. 3d cannot be removed from its position which wraps around the second upset 26b. Similarly, when the fluid 18 flows within the full bore 32, because of the pressure of the fluid 18 in the full bore 32, the second pair of upsets 20b1 and 20b2 in FIG. 4d cannot be removed from its position which wraps around the first upset 26a. Therefore, as long as fluid 18 flows within the full bore 32 in FIGS. 3d and 4d, the second pair of upsets 20b1 and 20b2 on the second mandrel 20b cannot be removed from its position which wraps around either the first upset 26a or the second upset 26b of the first pair of upsets 26a and 26b on the intermediate member 26; and, as a result, the central mandrel 20/second mandrel 20b is locked or latched in place within the outer housing 22 of the circulating sub 10. As long as the central mandrel 20 is locked or latched in place within the outer housing 22, the circulating sub 10 cannot change from a set, activated condition to a reset, deactivated condition shown in FIGS. 4a–4e, and, in the alternative, the circulating sub 10 cannot change from a reset, deactivated condition to a set, activated condition shown in FIGS. 3a–3e.

Figure 3E:
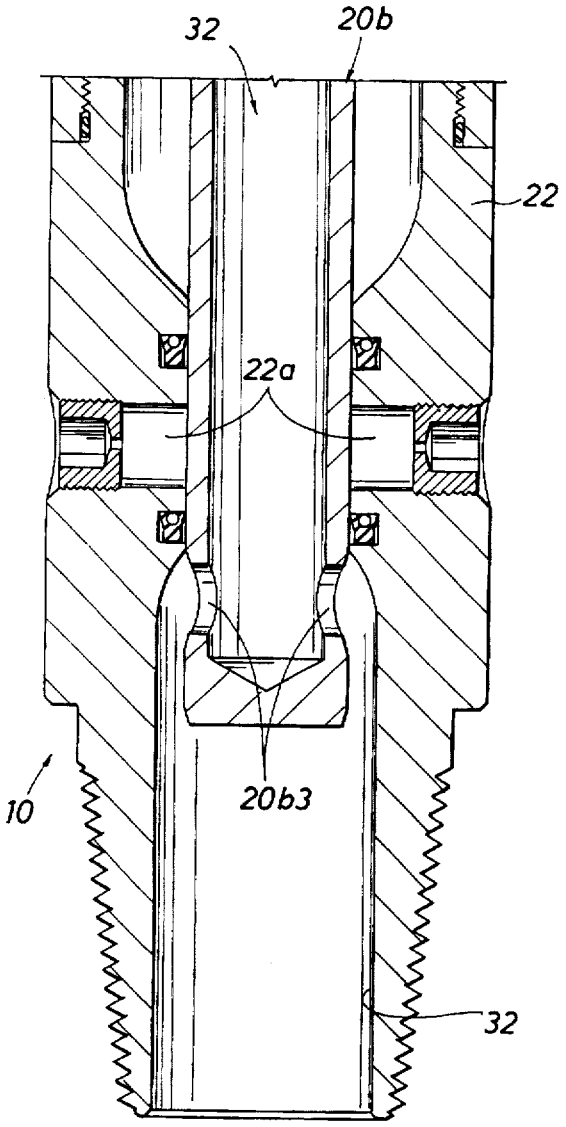
Figure 4E:
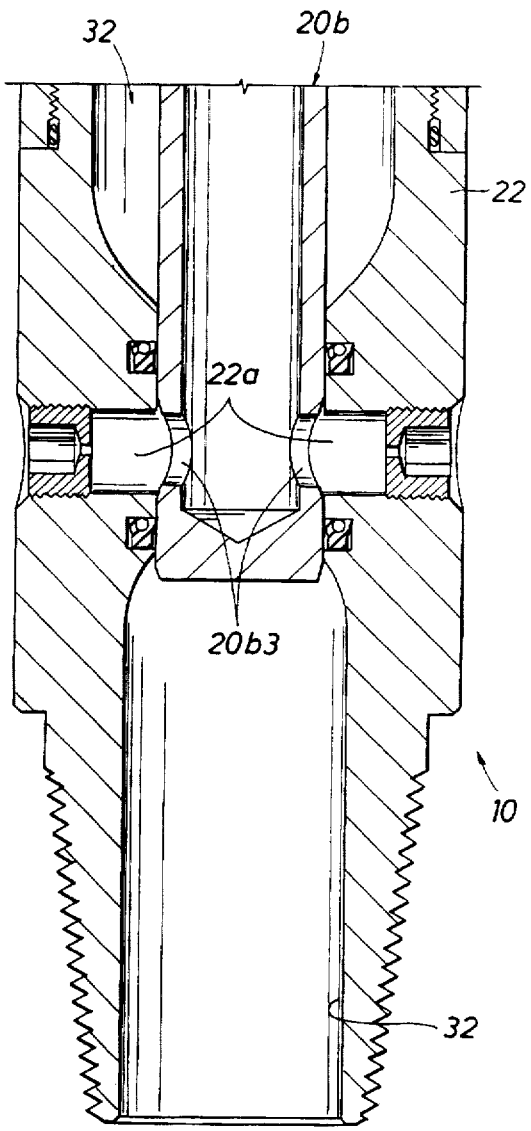

In FIGS. 3e and 4e, the second mandrel 20b of the central mandrel 20 is enclosed by the outer housing 22. In FIG. 4e, the second mandrel 20b of the central mandrel 20 is shown in a first lateral position; however, in FIG. 3e, the second mandrel 20b is shown in a second lateral position within the outer housing 22 of the circulating sub 10. The outer housing 22 includes a first pair of ports 22a, and the second mandrel 20b includes a second pair of ports 20b3 which are adapted to move into congruence with the first pair of ports 22a of the outer housing 22.

Therefore, in FIG. 4e, when the second mandrel 20b of the central mandrel 20 is disposed in the first lateral position within the circulating sub 10, the second pair of ports 20b3 of the second mandrel 20b are congruent with (in alignment with) the first pair of ports 22a of the outer housing 22. Therefore, in FIG. 4e, the fluid 18 flowing in the full bore 32 will flow from the full bore 32, through the second pair of ports 20b3, through the first pair of ports 22a, and into the wellbore, as shown in FIG. 2. In this condition, the circulating sub 10 of the present invention is disposed in the reset, deactivated condition of FIG. 2.

However, in FIG. 3e, when the second mandrel 20b of the central mandrel 20 is disposed in the second lateral position within the circulating sub 10, the second pair of ports 20b3 of the second mandrel 20b have moved out of congruence with (are no longer in alignment with) the first pair of ports 22a of the outer housing 22. Therefore, in FIG. 3e, the fluid 18 flowing in the full bore 32 will flow from the full bore 32, through the second pair of ports 20b3, back into the full bore 32 once again, through the downhole motor 14, and through the drill bit 16 as shown in FIG. 1. In this condition, the circulating sub 10 of the present invention is disposed in the set, activated condition of FIG. 1.

A functional description of the operation of the present invention will be set forth in the following paragraphs with reference to FIGS. 1 through 4e of the drawings.

Assume that the tool string of FIG. 1 is being used to drill a wellbore. The circulating sub 10 is disposed in the set, activated condition of FIG. 1; that is, the second mandrel 20b of the central mandrel 20 in FIG. 3e is disposed in the second lateral position within the circulating sub 10. In FIGS. 1 and 3e, when the second mandrel 20b is disposed in the second lateral position within the circulating sub 10, the ports 20b3 of the second mandrel 20b will not be congruent with (the ports 20b3 will be out of alignment with) the ports 22a of the outer housing 22, and the fluid 18 from the pump 15 in FIG. 1 flows through the coiled tubing 13, through the MWD tool 12, through the full bore 32 of the circulating sub 10, through the ports 20b3 of the second mandrel 20b of the circulating sub 10, back into the full bore 32 in FIG. 3e, through the downhole motor 14 and through the drill bit 16.

Assume further that the operator at the wellbore surface wants to change the condition of the circulating sub 10 from the set, activated condition of FIG. 1 to the reset, deactivated condition of FIG. 2. Since the circulating sub 10 of the present invention is being used, it is not necessary to retrieve the tool string of FIG. 1 to the surface of the wellbore for the purpose of resetting, deactivating the circulating sub. Once reset, the circulating sub 10 will perform in the manner shown in FIG. 2.

As long as the fluid 18 is being pumped from pump 15 through the full bore 32 of the tool string of FIG. 1 in the manner shown in FIG. 1, the operator at the wellbore surface cannot change the condition of the circulating sub 10 from the set, activated condition of FIG. 1 to the reset, deactivated condition of FIG. 2. This is true because, as shown in FIG. 3d, the second pair of upsets 20b1 and 20b2 on the second mandrel 20b in FIG. 3d are both held firmly against the second upset 26b of the first pair of upsets 26a and 26b on the intermediate member 26 by the fluid pressure of fluid 18 which exists within the full bore 32 in FIG. 3d. As long as the fluid 18 is being pumped into the full bore of FIG. 3d by pump 15, the second pair of upsets 20b1 and 20b2 will continue to wrap themselves around the second upset 26b on the intermediate member 26, and the second pair of upsets 20b1 and 20b2 will not be able to jump upwardly, as in FIG. 4d, to wrap themselves around the first upset 26a on the intermediate member 26. Consequently, the latch mechanism 30 locks and latches the circulating sub 10 of the present invention in the set, activated condition.

Assume now that the pump 15 of FIG. 1 stops pumping the fluid 18 through the tool string of FIG. 1. As a result, fluid pressure no longer exists within the full bore 32 of FIG. 3*d*. Consequently, the second pair of upsets 20*b*1 and 20*b*2 on the second mandrel 20*b* in FIG. 3*d* are no longer held firmly, by the fluid pressure, against the second upset 26*b* on the intermediate member 26. The latch mechanism 30 is unlocked and unlatched, and the circulating sub 10 can now change from the set, activated condition of FIG. 1 to the reset, deactivated condition of FIG. 2.

Therefore, since fluid pressure no longer exists within the full bore 32 of FIG. 3*d*, when the operator at the wellbore surface pulls upwardly on the coiled tubing 13 in FIG. 1 and moves the coiled tubing 13 upwardly by a distance of about 1½ inches, the second pair of upsets 20*b*1 and 20*b*2 on the second mandrel 20*b* (which are currently wrapped around the second upset 26*b* on the intermediate member 26) will jump upwardly and wrap themselves around the first upset 26*a* on the intermediate member 26, as shown in FIG. 4*d*. When this happens, the second mandrel 20*b* will move from its second lateral (set-activated) position shown in FIG. 3*e*, where the ports 20*b*3 in the second mandrel 20*b* are not congruent with the ports 22*a* in the outer housing 22, to a first lateral (reset-deactivated) position shown in FIG. 4*e*, where the ports 20*b*3 in the second mandrel 20*b* are congruent with and are in alignment with the ports 22*a* in the outer housing 22. At this point, the circulating sub 10 is disposed in the reset, deactivated condition shown in FIG. 2. When the pumps 15 are restarted, the fluid 18 begins to flow once again through the full bore 32 in FIG. 4*d*, through the full bore 32 in FIG. 4*e*, through the ports 20*b*3 in the mandrel 20*b* in FIG. 4*e*, through the ports 22*a* in the outer housing 22 in FIG. 4*e*, and into the wellbore in the manner shown in FIG. 2 of the drawings. Since fluid 18 is flowing through the full bore 32 in FIG. 4*d*, the latch mechanism 30 once again has locked and latched the circulating sub 10 in the reset, deactivated condition.

When the second mandrel 20*b* moves to the first lateral reset-deactivated position shown in FIG. 4*e*, where the ports 20*b*3 are in alignment with the ports 22*a*, flow through the drilling motor 14 is blocked and bypassed in the manner shown in FIG. 2 and the drill bit 16 does not turn and rotate. This prevents sidetracking accidentally or wearing out the tubing or casing. One can circulate and sweep cuttings out of the hole at a much higher circulating rate than would be possible when circulating through the downhole motor. When the fluid 18 in FIG. 1 is diverted past the downhole motor 14 in the manner shown in FIG. 2, the motor 14 and the drill bit 16 no longer operate. The MWD tool 12 can be operated without also operating the downhole motor 14 or rotating the drill bit 16. One can start or cease operation of the downhole motor 14 by operating the circulating sub 10 of the present invention and still be able to circulate, transmit MWD signals to the surface, take surveys, multishots, and whatever operations are necessary.

If it subsequently becomes necessary to change the condition of the circulating sub 10 from the reset, deactivated condition shown in FIG. 2 to the set, activated condition shown in FIG. 1, the pumps 15 are again stopped, which stops the flow of the fluid 18 into the tool string of FIG. 2. When the flow of fluid 18 through the full bore 32 in FIG. 4*d* is stopped, the latch mechanism 30 unlocks and unlatches the circulating sub 10 from the reset, deactivated condition. As a result, the coiled tubing 13 can be pushed downwardly by the operator at the wellbore surface by a distance of about 1½ inches. This push downwardly on the coiled tubing 13 will cause the second pair of upsets 20*b*1 and 20*b*2 on the second mandrel 20*b* (which are currently wrapped around the first upset 26*a* on the intermediate member 26) to jump downwardly and wrap themselves around the second upset 26*b* on the intermediate member 26, as shown in FIG. 3*d*. When this happens, the second mandrel 20*b* will move from its first lateral (reset-deactivated) condition shown in FIG. 4*e*, where the ports 20*b*3 in the second mandrel 20*b* are congruent with the ports 22*a* in the outer housing 22, to the second lateral (set-activated) condition shown in FIG. 3*e*, where the ports 20*b*3 in the second mandrel 20*b* are not congruent with and are not in alignment with the ports 22*a* in the outer housing 22. At this point, the circulating sub 10 is disposed in the set, activated condition shown in FIG. 1.

The above referenced process of repeatedly setting and resetting the circulating sub 10 of the present invention can be accomplished without pulling the tool string including the circulating sub 10 out of the wellbore for the purpose of resetting the sub 10. As a result, by using the new downhole activated circulating sub 10 of the present invention, time and money is saved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A circulating sub having a full bore adapted to be disposed in a wellbore, comprising:

a mandrel adapted to move laterally between a first lateral position and a second lateral position within the circulating sub, said mandrel having a port;

a housing enclosing said mandrel, said housing having a port; the port in said mandrel being adapted to move into or out of alignment with said port in said housing when said mandrel moves between said first lateral position and said second lateral position within said circulating sub;

latch means for locking said mandrel in either said first lateral position or said second lateral position and unlocking said mandrel from either said first lateral position or said second lateral position within said circulating sub, the port in said mandrel moving into or out of said alignment with said pod in said housing when said latch means unlocks said mandrel from either said first lateral position or said second lateral position;

means for receiving a fluid through the full bore of said circulating sub; and means for stopping the flow of fluid through the bore;

said latch means unlocking said mandrel for movement between a first lateral position and a second lateral position only when the flow of fluid through the bore is stopped.

2. The circulating sub of claim 1, wherein said housing includes a pair of ports, said mandrel further including a pair of ports adapted to move into and out of alignment with said pair of ports in said housing, said pair of ports in said mandrel moving out of alignment with said pair of ports in said housing when said latch means unlocks said mandrel and said mandrel moves from said first lateral position to said second lateral position within said circulating sub.

3. A method of changing a circulating sub having a full bore between a set condition and a reset condition while said circulating sub is disposed in a wellbore, a tubing being connected to said sub when said sub is disposed in said wellbore, said sub having latching means for locking said circulating sub in either said set or said reset condition and unlocking said circulating sub from either said set condition or said reset condition, said circulating sub changing between said set condition and said reset condition when said latching means unlocks said circulating sub from either said set condition or said reset condition, and a fluid adapted to flow in said full bore of said sub, comprising the steps of:

stopping the flow of said fluid through said full bore of said circulating sub;

moving said tubing a predetermined distance; and changing said sub between said set condition and said reset condition by actuation of said latching means in response to the moving step only when the flow of fluid has been stopped.

4. The method of claim 3, wherein said circulating sub includes a mandrel having a pair of upsets and another member having a first upset and a second upset, said pair of upsets on said mandrel adapted to wrap around either said first upset or said second upset on said another member, said circulating sub being in said set condition when said pair of upsets on said mandrel wraps around said first upset on said another member, said sub being in said reset condition when said pair of upsets on said mandrel wraps around said second upset on said another member.

5. The method of claim 4, wherein the step of changing said sub between said set condition and said reset condition comprises the steps of:

moving said mandrel in response to the step of moving said tubing said predetermined distance; and relocating a position of said pair of upsets on said mandrel from a first position to a second position in response to the step of moving said mandrel, said pair of upsets on said mandrel wrapping around said first upset on said another member when said pair of upsets on said mandrel is located in said first position, said pair of upsets on said mandrel wrapping around said second upset on said another member when said pair of upsets on said mandrel is located in said second position.

6. A system adapted to be disposed in a wellbore, comprising:

a measurement while drilling tool;

a drill bit and a downhole motor connected to said drill bit for rotating said drill bit; and a circulating sub interconnected between said measurement while drilling tool and said downhole motor adapted to be disposed in either a set condition or a reset condition, said circulating sub including, latching means for locking said circulating sub in either said set condition or said reset condition or unlocking said circulating sub from either said set condition or said reset condition, said circulating sub changing between said set condition and said reset condition when said latching means unlocks said circulating sub from either said set condition or said reset condition, said downhole motor rotating said drill bit when said circulating sub is disposed in said set condition, said downhole motor not rotating said drill bit when said circulating sub is disposed in said reset condition.

7. The system of claim 6, wherein said circulating sub includes a full bore, and wherein said latching means of said circulating sub comprises:

means for receiving a fluid through the full bore of said circulating sub;

mandrel means for moving longitudinally within said sub when said fluid stops flowing from said means for receiving through said full bore of said circulating sub, said mandrel means including a pair of upsets;

member means for remaining stationary within said sub, said member means including a first upset and a second upset, said pair of upsets on said mandrel means adapted to wrap around either said first upset or said second upset on said member means, said circulating sub changing between said set condition and said reset condition when said mandrel means moves longitudinally within said sub and said pair of upsets on said mandrel means moves from a first position where said pair of upsets are wrapped around said first upset of said member means to a second position where said pair of upsets are wrapped around said second upset of said member means.

8. A circulating sub having a full bore and adapted to be interconnected between a measurement while drilling tool and a downhole motor in a wellbore and adapted to change between a set condition and a reset condition, comprising:

latching means for locking said circulating sub in either said set condition or said reset condition and unlocking said circulating sub from either said set condition or said reset condition, said circulating sub changing between said set condition and said reset condition when said latching means unlocks said circulating sub from either said set condition or said reset condition;

means for receiving a fluid through the full bore of said circulating sub; and means for stopping the flow of fluid through said bore;

said latching means unlocking said circulating sub from either said set condition or reset condition only when the flow of fluid through said bore is stopped.

9. A system adapted to be disposed in a wellbore comprising:

a measurement while drilling tool;

a drill bit and a downhole motor connected to said drill bit for rotating said drill bit; and a circulating sub having a full bore interconnected between said measurement while drilling tool and said downhole motor, said circulating sub adapted to be disposed in either a set condition or a reset condition and comprising a mandrel adapted to move laterally between a first lateral position and a second lateral position within the circulating sub, said mandrel having a port;

a housing enclosing said mandrel, said housing having a port, the port in said mandrel being adapted to move into or out of alignment with said port in said housing when said mandrel moves between said first lateral position and said second lateral position within said circulating sub; and latch means for locking said mandrel in either said first lateral position or said second lateral position and unlocking said mandrel from either said first lateral position or said second lateral position within said circulating sub, the port in said mandrel moving into or out of said alignment with said port in said housing when said latch means unlocks said mandrel from either said first lateral position or said second lateral position.

10. A circulating sub having a full bore adapted to flow of fluid therethrough and to be disposed in a wellbore, comprising:

a mandrel adapted to move laterally between a first lateral position and a second lateral position within the circulating sub, said mandrel having a port;

a housing enclosing said mandrel, said housing having a port, the port in said mandrel being adapted to move into or out of alignment with said port in said mandrel moves between said first lateral position and said second lateral position within said circulating sub;

latch means for locking said mandrel in either said first lateral position or said second lateral position and unlocking said mandrel from either said first lateral position or said second lateral position within said circulating sub, the port in said mandrel moving into or out of said alignment with said port in said housing when said latch means unlocks said mandrel from either said first lateral position or said second lateral position;

said housing including a pair of ports, said mandrel further including a pair of ports adapted to move into and out of alignment with said pair of ports in said housing, said pair of ports in said mandrel moving out of alignment with said pair of ports in said housing when said latch means unlocks said mandrel and said mandrel moves from said housing when said latch means unlocks said mandrel and said mandrel moves from said first lateral position to said second lateral position within said circulating sub;

said latch means comprising:

an intermediate member having a first upset and a second upset; and said mandrel including a pair of upsets, said pair of upsets on said mandrel wrapping around either said first upset or said second upset on said intermediate member, said latch means locking said mandrel in either said first lateral position or said second lateral position within said circulating sub when said fluid flows within said full bore and said pair of upsets on said mandrel wrap around either said first upset or said second upset on said intermediate member.

11. A circulating sub having a full bore and adapted to be interconnected between a measurement while drilling tool and a downhole motor in a wellbore and adapted to change between a set condition and a reset condition, comprising:

latching means for locking said circulating sub in either said set condition or said reset condition and unlocking said circulating sub from either said set condition or said reset condition, said circulating sub changing between said set condition and said reset condition when said latching means unlocks said circulating sub from either said set condition or said reset condition;

said latching means of said circulating sub comprising:

means for receiving a fluid through the full bore of said circulating sub;

mandrel means for moving longitudinally within said sub when said fluid stops flowing from said means for receiving through said full bore of said circulating sub, said mandrel means including a pair of upsets; and member means for remaining stationary within said sub, said member means including a first upset and a second upset, said pair of upsets on said mandrel means adapted to wrap around either said first upset or said second upset on said member means;

said circulating sub changing between said set condition and said reset condition when said mandrel means moves longitudinally within said sub and said pair of upsets on said mandrel means moves from a first position where said pair of upsets are wrapped around said first upset of said member means to a second position where said pair of upsets are wrapped around said second upset of said member means.

12. A system adapted to be disposed in a wellbore, comprising:

a tubular drill string assembly including;

a drill bit and a downhole motor connected to said drill bit adjacent the lower end of said assembly for rotating said drill bit; and a circulating sub above said downhole motor adapted to be disposed in either a set condition or a reset condition, said circulating sub including, latching means for locking said circulating sub in either said set condition or said reset condition or unlocking said circulating sub from either said set condition or said reset condition, said circulating sub changing between said set condition and said reset condition when said latching means unlocks said circulating sub from either said set condition or said reset condition, said downhole motor rotating said drill bit when said circulating sub is disposed in said set condition, said downhole motor not rotating said drill bit when said circulating sub is disposed in said reset condition.

* * * * *